US006299387B1

(12) United States Patent
Andersson

(10) Patent No.: US 6,299,387 B1
(45) Date of Patent: Oct. 9, 2001

(54) METHOD FOR EVACUATING A STORAGE SILO FOR BULK GOODS, E.G. CEREAL GRAIN, AND AN EVACUATION CONVEYOR THERETO

(76) Inventor: Rolf Andersson, 534 94 Vara, Snickebo Tumleberg (SE)

( * ) Notice: Subject to any disclaimer, the term of this patent is extended or adjusted under 35 U.S.C. 154(b) by 0 days.

(21) Appl. No.: 09/603,149

(22) Filed: Jun. 23, 2000

Related U.S. Application Data

(63) Continuation of application No. PCT/SE98/02448, filed on Dec. 23, 1998.

(51) Int. Cl.[7] ..... B65G 51/00

(52) U.S. Cl. ..... 406/198; 406/110; 406/138; 406/146

(58) Field of Search ..... 406/109, 110, 406/137, 138, 146, 198

(56) References Cited

U.S. PATENT DOCUMENTS

| | | | | |
|---|---|---|---|---|
| 4,082,205 | * | 4/1978 | Kluger et al. | 222/193 |
| 4,088,373 | * | 5/1978 | White | 302/29 |
| 4,508,474 | | 4/1985 | Frederick . | |
| 4,560,094 | * | 12/1985 | Eales | 222/195 |
| 5,335,828 | * | 8/1994 | Kaiju et al. | 406/137 |
| 5,346,101 | * | 9/1994 | Hargis et al. | 406/146 |

FOREIGN PATENT DOCUMENTS

| | | |
|---|---|---|
| 37 17 490 A1 | 12/1988 | (DE) . |
| 2.032.124 | 11/1970 | (FR) . |
| 218 067 | 1/1968 | (SE) . |
| 414 161 | 7/1980 | (SE) . |
| 459 575 | 9/1988 | (SE) . |
| WO 88/06560 | 9/1988 | (WO) . |

* cited by examiner

*Primary Examiner*—Christopher P. Ellis
*Assistant Examiner*—Joe Dillon, Jr.
(74) *Attorney, Agent, or Firm*—Marshall, Gerstein & Borun

(57) ABSTRACT

A conveyor comprises perforation bands arranged in the floor of a storage space. Some of the bands emit an air stream that in quantity or pressure differs from the air stream in the remaining bands and have apertures with a larger flow area than the apertures in the remaining bands. The larger apertures are provided: along with a first perforation band placed in the middle of a sector of the floor and extending across the entire sector; along one further band arranged on one side of the first band with a shorter extension than in the first band; and in portions of bands which portions are closest to the walls of the storage space.

8 Claims, 6 Drawing Sheets

METHOD FOR EVACUATING A STORAGE SILO FOR BULK GOODS, E.G. CEREAL GRAIN, AND AN EVACUATION CONVEYOR THERETO

This is a continuation of International Application No. PCT/SE98/02448, filed Dec. 23, 1998.

The present invention relates to a method for evacuating storage spaces for bulk goods, preferably granulate material, e.g. cereal grain, by means of an evacuation conveyor constituting the floor of the silo, which is provided with perforations arranged in bands as passages for air flows, which are directed along the floor and blow the bulk material towards an outlet, an outlet chute or the like. The invention also relates to an evacuation conveyor.

BACKGROUND OF THE INVENTION AND UNDERLYING PROBLEM

Silos for cereal grain and the like are evacuated by means of allowing the grain to flow out through an outlet in the bottom of the silo. In order to be able to utilize the volume of the silo to the greatest possible extent, the silo bottom is conveniently arranged in a horizontal direction, resulting in the formation of a remaining residue of bulk goods, corresponding to the angle of repose of the material in question, which has its largest height at the silo walls and slopes towards the outlet or the outlets. Thereby, it is desired that this remaining material is evacuated by means of an evacuation conveyor, which consists of a floor having a number of bands of perforations, through which perforations jets of pressurized air directed along the floor pass, and bring the bulk goods into movement towards an outlet opening or the like. SE 218067 C and SE 459 575 B are examples of previously known devices of this type.

A disadvantage with these previously known devices is that the pressurized air locates passages in which the lowest resistance prevail, i.e. where the layer of bulk goods is the thinnest, thereby leaving the thicker portions more or less unaffected. In the positions where the pressurized air has been able to transport away the goods, empty or sparsely coated floor areas are created, and a considerable portion of the pressurized air flows out from the silo without having been effective in the displacement of the cereal grain.

PURPOSE OF THE INVENTION AND SOLUTION TO THE PROBLEM

The purpose of the invention is to achieve an evacuation conveyor:

- which occupies a very small storage volume,
- which evacuates the space nearly up to 100% without any manual operation,
- a which consumes considerably less air than the previously known, corresponding devices
- which has a modular construction and is easy to transport and assemble,
- which is no more expensive than conventional devices
- which lacks movable parts,
- which easily can be adapted to transport different types of granular material These objectives have been achieved by means of causing at least portions of the perforation bands closest to the side walls of the storage space, and some of the bands along essentially their entire and/or part of their length, to emit an air stream which in quantity and/or pressure differs from the air stream emitted in the remaining perforation bands.

BRIEF DESCRIPTION OF THE DRAWINGS

In the following, the invention will be described in greater detail in the form of an embodiment with reference to the attached drawings.

DETAILED DESCRIPTION OF PREFERRED EMBODIMENT

Figure 1:
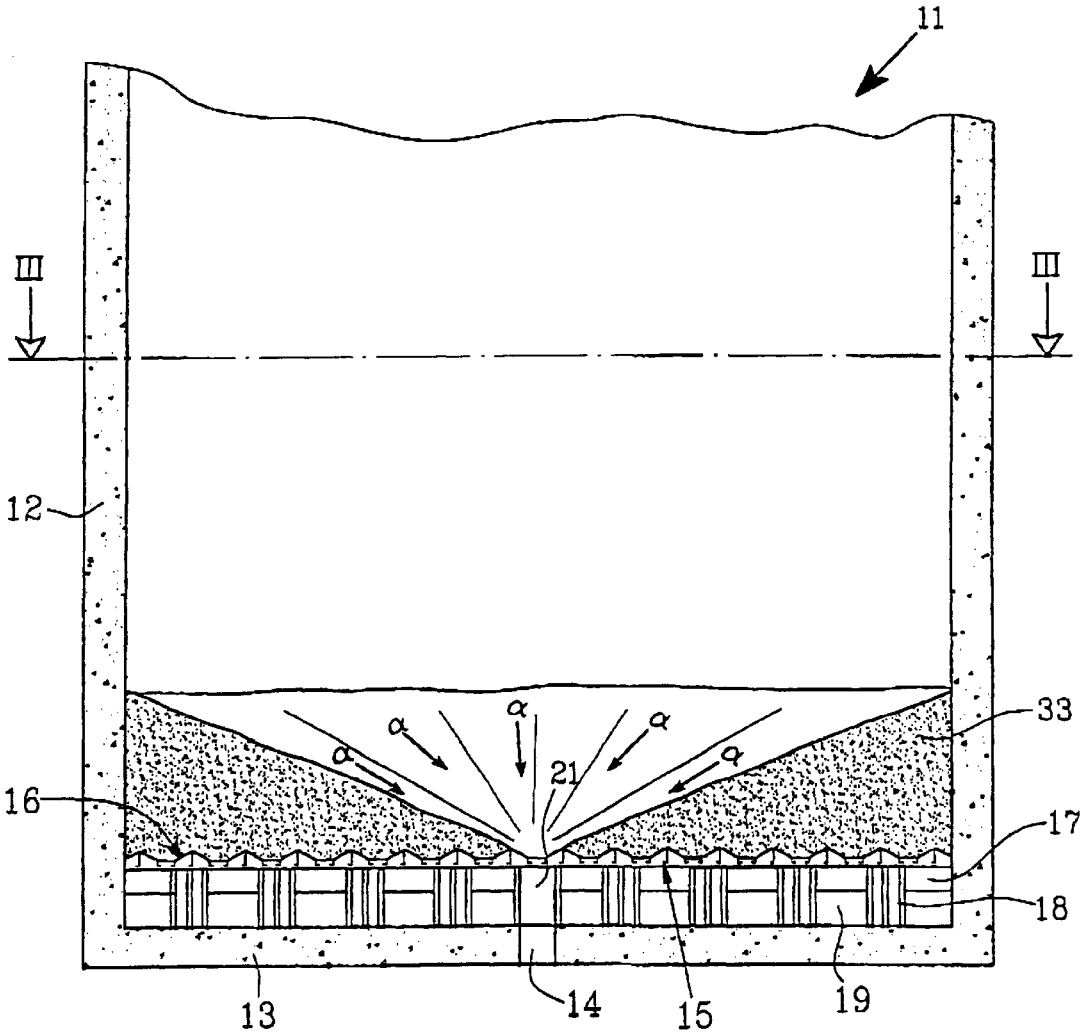
FIG. 1 shows a section through a storage silo with an evacuation conveyor according to the invention.
Figure 3:
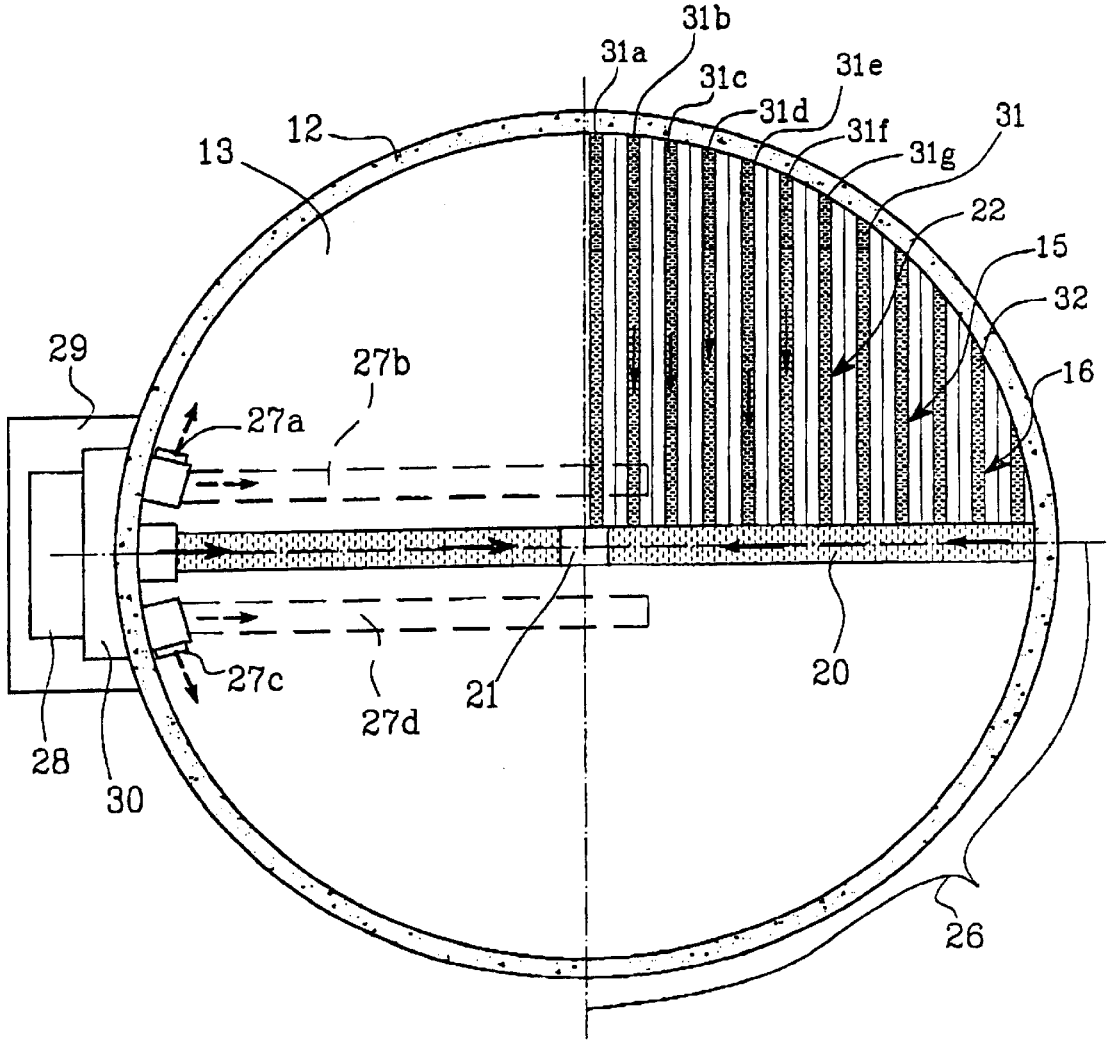
FIG. 3 shows a section along the line III—III in FIG. 1.
Figure 4:
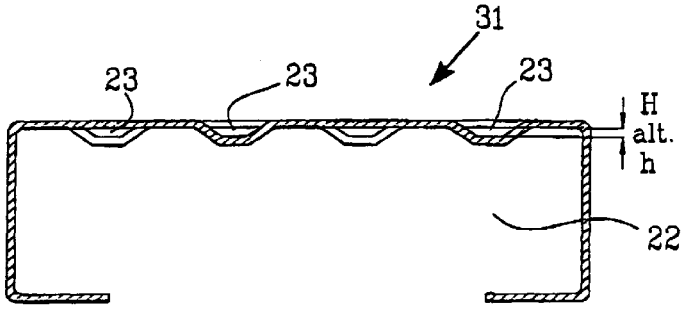
FIG. 4 shows a section along the line IV—IV in FIG. 5.

The storage space 11 shown in FIGS. 1 and 3 is constituted of a concrete silo having a circular cross-section, with silo walls 12 and an essentially horizontal bottom 13, in which an evacuation opening 14 is centrally arranged. On the bottom 13, an evacuation conveyor 15 is placed which covers the entire silo bottom and forms the floor 16 of the silo. In this context, evacuation conveyor means a device, previously known per se, for horizontal transport of bulk goods along a floor, provided with apertures which are directed so that an air stream through these displaces the material on the floor towards the evacuation conveyor.

In the shown embodiment, the evacuation conveyor 15 is constituted of a platform 17, arranged at a distance from the silo bottom 13 by means of legs 18, so that an air chamber 19 is formed underneath the platform. This is constituted of U-beams, arranged at a distance from each other, on top of which the floor 16 itself rests.

As is evident from FIG. 3, the floor is diametrically divided into two halves by an open feeder chute 20. In the center of the silo, an outlet 21 is arranged in the feeder chute which communicates with the evacuation opening 14 of the silo. The floor 16 comprises a number of deflector channels 22, which in the shown example are constituted of U-shaped sheet metal profiles, but which also can be pipes with a rectangular cross-section. On their top side, the deflector channels 22 are provided with apertures 23, constituted of slits, which on one side are punched downwards from the plane of the sheet metal profile, in order to form a nozzle having a parallel trapezoidal cross-section which is directed essentially in the plane of the floor. The deflector channels 22 are arranged essentially perpendicularly to the feeder chute 20, which discharges in at least one outlet 21. Each deflector channel 22 is on both long sides flanked by distribution ridges 24 in the form of ridge plates, with surfaces sloping from the ridge 25 towards the deflector channels. The ridge 25 is located on a higher level than the deflector and has the task of guiding the bulk material towards the deflector channels. The ridge plates preferably have a minimum slope, corresponding to the angle of repose of the bulk material.

As is evident from FIG. 3, with regard to the air distribution, the evacuation conveyor 15 is divided into sectors 26 sealed from each other, in the shown example in quadrants, wherein each sector via its respective air channel 27*a*–27*d* is connected to a source of pressurized air, e.g. a fan 28 or the like arranged outside the silo in a fan house 29. By means of a control member 30, either all sectors, or the sectors individually or in groups, can be connected to the fan. The control member can be controlled e.g. by means of a processor, which intermittently connects the sectors according to a circulating scheme, wherein for example one sector during a short period of time is pressurized with the entire pressure power of the fan, alternating with periods with a lower pressure in which the air is distributed across several sectors.

Figure 2:
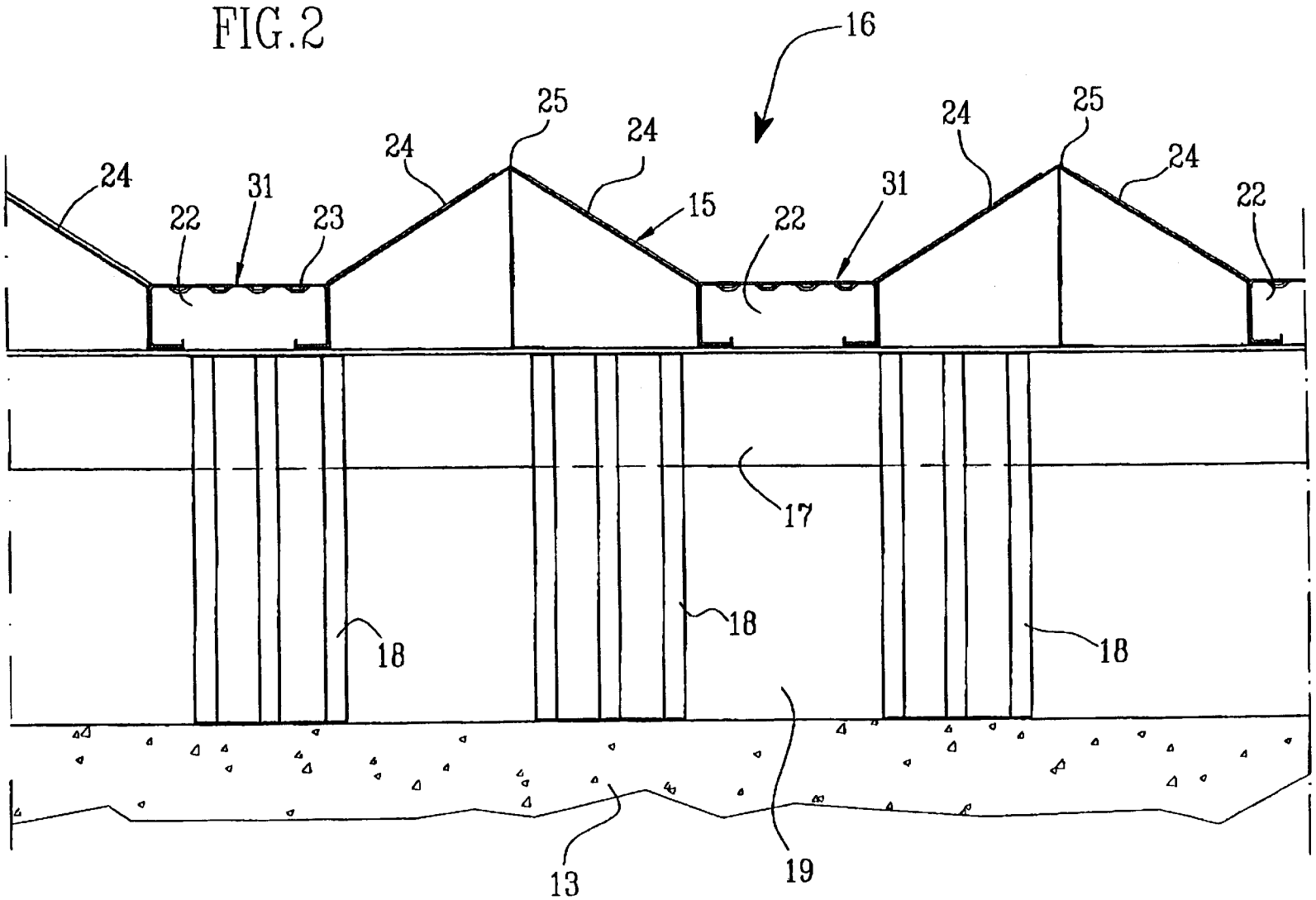
FIG. 2 shows, in magnification, a portion of the floor construction.
Figure 7:
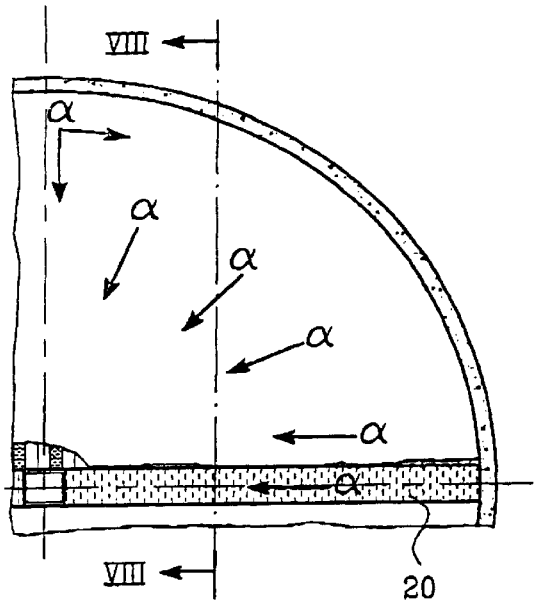
FIGS. 7, 9 and 10 show top views of a sector of the evacuation conveyor in different evacuation stages.
Figure 8:
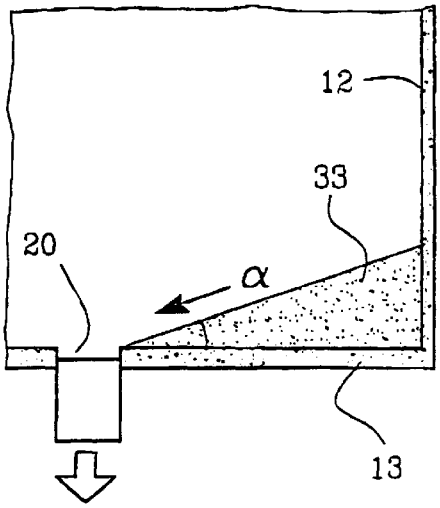
FIG. 8 is a section along the line VIII—VIII in FIG. 7.

A problem, when evacuating the last remaining residue after the gravitational evacuation has stopped, is that the material mass formed according to the angle of repose of the bulk goods 33, se FIGS. 7 and 8, is reduced by the influence of the air streams only at the front edge of the mass closest to the feeder chute 20, without any significant effect on the material lying behind. In order to cope with this problem, see FIGS. 9 and 10 and FIG. 2, according to the invention at least portions of the perforation bands 31 formed by the deflector channels 22 which are located closest to the silo wall 12, and some of the bands along their entire and/or part of their length, have been provided with apertures 23 having a larger flow area than the apertures 23 in the remaining perforation bands 32. The open feeder chute 20 is also provided with the same type of perforation 31' as the deflector channels 22, the apertures of which are directed towards the outlet 21 or, in the case of several outlets, towards one of these.

Figure 5:
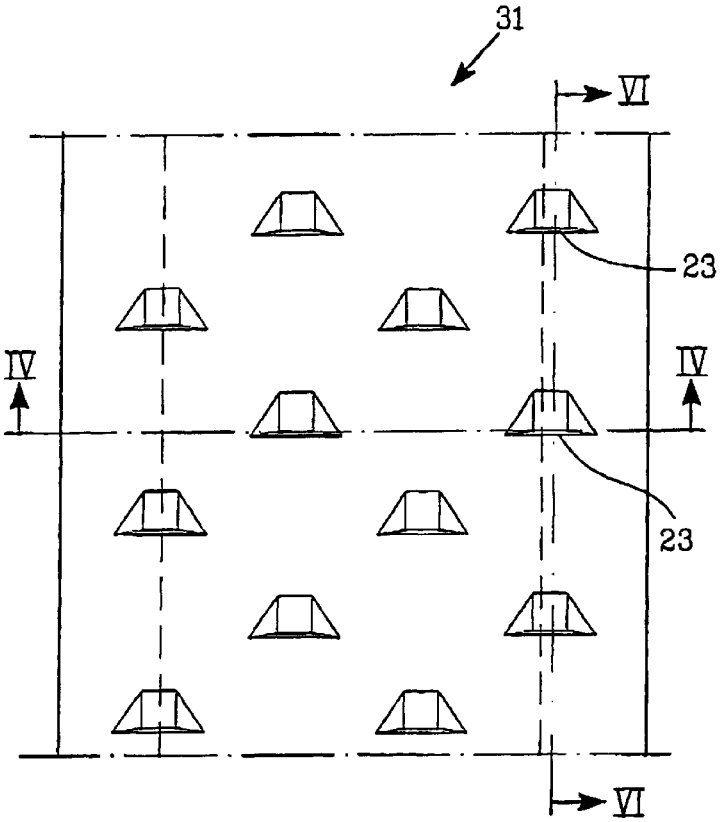
FIG. 5 shows a top view of a portion of a deflector channel.
Figure 6:
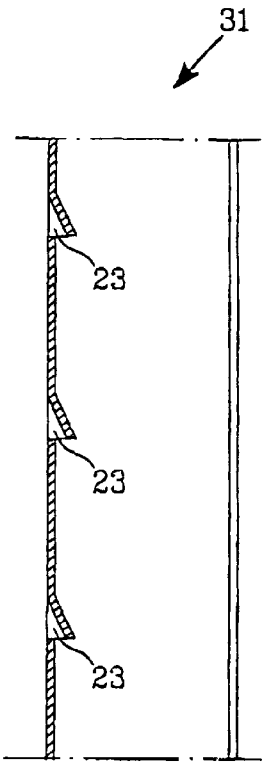
FIG. 6 shows a section along the line VI—VI in FIG. 5.

In FIG. 3, this is illustrated in a quadrant of the evacuation conveyor, wherein the perforation bands 31 are shown with closer sectioning for apertures 23 having a larger flow area, while more sparsely sectioned perforation bands have a smaller flow area. The relative difference in size between the apertures is 15–50%. The measure H, i.e. the height of the slit in FIG. 5, can suitably vary between 1.8–2.0 mm for the larger apertures and the measure h between 1.2–1.4 mm for the smaller apertures. In experiments, it has been found that there should be apertures having a larger flow area:

along at least one perforation band 31*e* placed approximately in the middle of the sector and extending across the entire sector 26, in one or two perforation bands 31*c* on one or both sides of the band 31*e* which has/have a slightly smaller length, e.g. ¾ of 31*e*, and closest to the silo walls 12 with an extension of approx. ⅓ of the total length.

Figure 9:
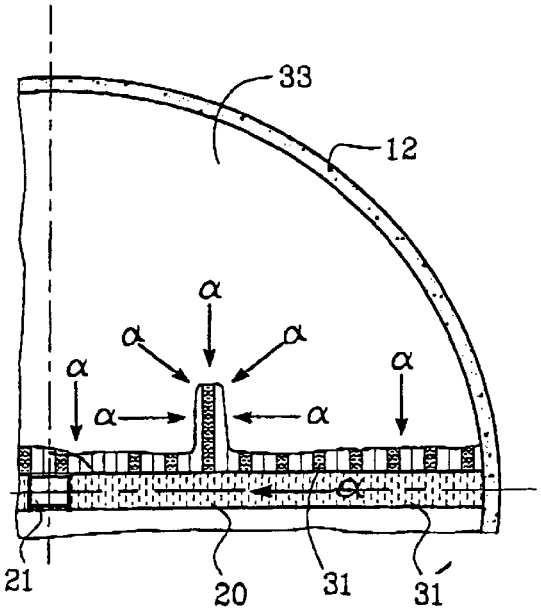
Figure 10:
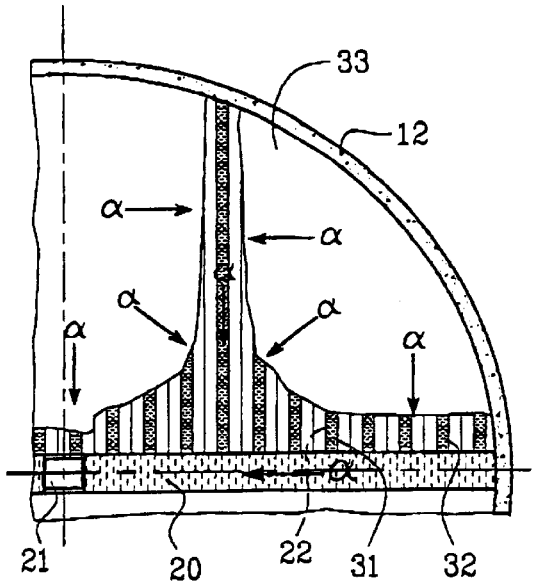
Figure 11:
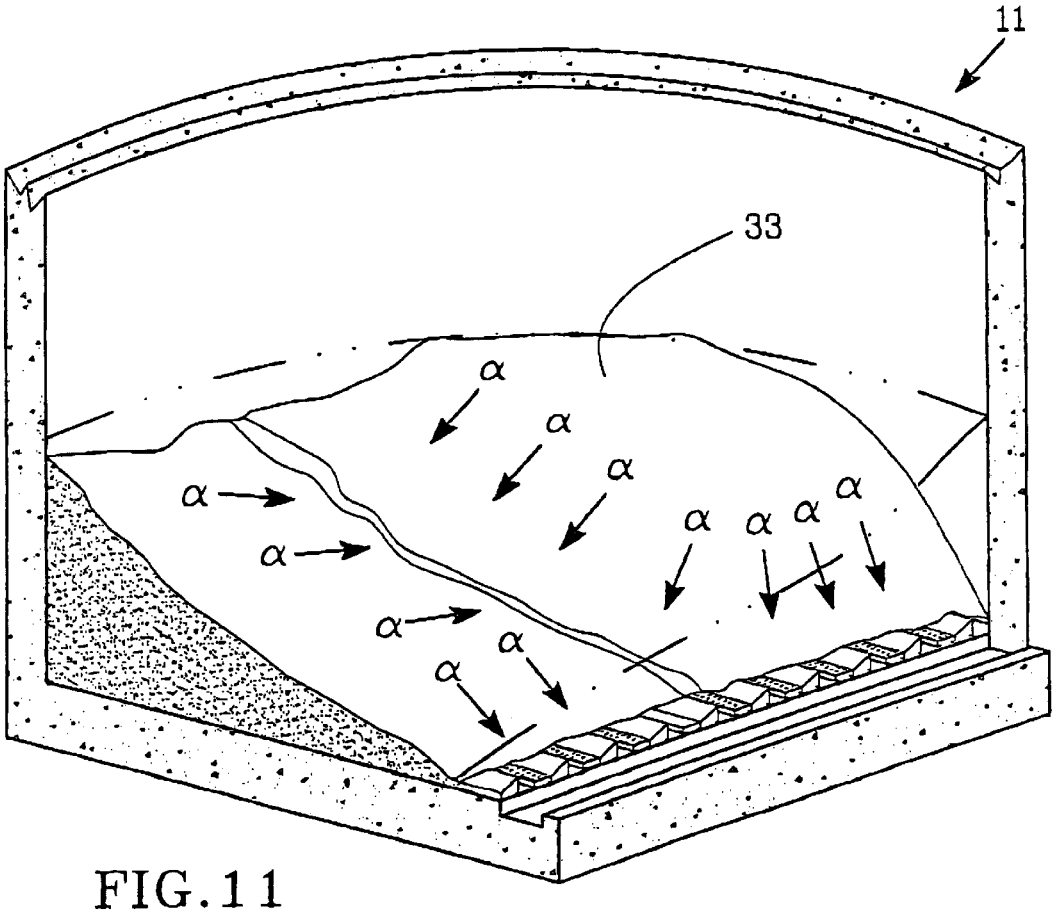
FIG. 11 shows a perspective view of a sector of a storage space with the evacuation conveyor according to the invention.

By means of this construction of the evacuation conveyor it is achieved that, when starting from the initial situation shown in FIGS. 7 and 9, after gravitational evacuation has finished a band-shaped cut is formed in the bulk mass in addition to a reduced withdrawal of the front edge of the bulk mass towards the outlet 21, according to FIGS. 9 and 10. As the perforation band 31' of the feeder chute 20 and the perforation band 31 of the deflector channels "grow" into the bulk mass, this will fall down at the side of and along the bands, see FIG. 11, whereby an effective breaking up of the bulk mass 33 in the storage space 11 is obtained, without exposing large areas through which the air can escape without having effected any work. Since the breaking up takes place along several perforation bands simultaneously, also an transverse evening out of the bulk mass occurs during the major pan of the evacuation.

Practical tests have proven that, in a comparison between the evacuation conveyor according to the invention and a conventional evacuation conveyor with essentially the same aperture dimensions, the first reduces the air need with up to 28% at the same evacuating capacity.

The invention is not limited to the shown embodiment, but a number of variations are conceivable within the scope of the claims. Accordingly, the invention can be applied for any storage space, independently of whether it has a circular, rectangular or another cross-sectional shape. It can also be applied in such silos which have a sloping bottom, but where there is a desire to improve the evacuation efficiency. Also deflector channels which are arranged radially are conceivable, as well as bottoms with several outlet openings.

LISTING OF REFERENCE NUMERALS

11 storage space, e.g. silo
12 silo wall
13 silo bottom
14 evacuation opening
15 evacuation conveyor
16 floor
17 platform
18 legs
19 air chamber
20 feeder chute
21 outlet
22 deflector channel
23 apertures
24 distribution ridge=ridge plate
25 ridge
26 sector
27*a*–27*d* air channel
28 fan
29 fan house
30 control members
31 perforation band with larger apertures
31' perforation band at the feeder chute
32 perforation band with smaller apertures
33 bulk mass

What is claimed is:

1. An evacuation conveyor for storage spaces for bulk goods, wherein:

a. The floor of the storage space is provided with perforation bands in the form of air-permeable apertures, b. Means for producing and guiding pressurized air to the underside of the floor are provided which conveys said bulk goods, c. At least a number of said apertures are designed as nozzles, which are oriented so that the air stream through these is directed along the floor towards an outlet, characterized in that d. At least portion of the perforation bands closest to a side wall of the storage space, and some of the bands along essentially their entire and/or part of their length, emit an air stream which in quantity and/or pressure differ from the air stream emitted in the remaining perforation bands, and that apertures with a larger flow area than the apertures in the remaining perforation bands are provided:

along at least a first perforation band placed approximately in the middle of a sector of said floor and extending across the entire sector, and along one or two further perforation bands, on one or both sides of said first perforation band (31*e*), but with a shorter extension than in said perforation band, and in at least portions of the perforation bands closest to said side wall, with an extension of approximately ⅓ of the total length of these perforation bands.

2. An evacuation conveyor according to claim 1, characterized in that the perforation bands in a lateral direction are separated by non-perforated portions, and that portions of the perforation bands closest to the side walls of the evacuation conveyor and some of the bands along their entire and/or part of their length are pressurized with an essentially constant air pressure and designed with nozzle openings, which have a larger cross-sectional area than the remaining apertures or successively increasing or group-wisely increasing cross-sectional area, and/or are pressurized with pressurized air of a higher pressure than the remaining portions of the floor and designed with nozzle openings of an equal size.

3. An evacuation conveyor according to claim 1, characterized in that, with regard to the air distribution, the floor surface is divided into at least two halves by means of at least one feeder chute, and that each half in turn is divided into sectors forming quadrants.

4. An evacuation device according to claim 1, characterized in that air control members are connected to each sector, and/or to certain perforation bands within this, for intermittent connection of the source of pressurized air and/or (choking) of the supplied quantity of pressurized air.

5. An evacuation device according to claim 1, characterized in that the difference in size of the apertures is between about 15 to 50%.

6. An evacuation device according to claim 1, characterized in that the floor is constituted of sheet metal modules, comprising said perforation bands consisting of U-profiles, the central portion of which between the legs is perforated and to which legs distribution ridges, in the form of sloping ridge plates forming surfaces sloping towards the perforation, are connected.

7. An evacuation device according to claim 1, characterized in that each aperture is constituted of a slit, which has been punched out from the plane of the plate, forming a nozzle having a parallel trapezoidal cross-section, the width of which is essentially a power of ten larger than its height.

8. An evacuation device according to claim 1, characterized in that the pressure difference between different groups of perforation bands is in a ratio of 1:2.

* * * * *